US006860949B1

(12) United States Patent
Weber

(10) Patent No.: US 6,860,949 B1
(45) Date of Patent: Mar. 1, 2005

(54) HIGH STRENGTH, TARNISH RESISTANT COMPOSITION OF MATTER

(75) Inventor: J. David Weber, Cedar Park, TX (US)

(73) Assignee: Commemorative Brands, Inc., Austin, TX (US)

( * ) Notice: Subject to any disclaimer, the term of this patent is extended or adjusted under 35 U.S.C. 154(b) by 236 days.

(21) Appl. No.: 10/314,800

(22) Filed: Dec. 9, 2002

Related U.S. Application Data

(60) Provisional application No. 60/339,572, filed on Dec. 10, 2001.

(51) Int. Cl.[7] ..... C22C 5/00

(52) U.S. Cl. ..... 148/430; 148/431; 420/502; 420/503

(58) Field of Search ..... 148/430, 431; 420/502, 503

(56) References Cited

U.S. PATENT DOCUMENTS 5,876,862 A * 3/1999 Shibuya et al. ..... 428/672
6,723,281 B1 * 4/2004 Ueno et al. ..... 420/503

* cited by examiner

*Primary Examiner*—Sikyin Ip
(74) *Attorney, Agent, or Firm*—J. Nevin Shaffer, Jr.

(57) ABSTRACT

A high strength, tarnish resistant composition of matter includes approximately 90 percent Ag, 3 to 5 percent Pt and 7 to 5 percent Cu. In a preferred embodiment, the composition of matter includes 90 percent Ag, 3 percent Pt and 7 percent Cu. In another preferred embodiment, the composition of matter includes 90 percent Ag, 5 percent Pt and 5 percent Cu.

12 Claims, No Drawings

HIGH STRENGTH, TARNISH RESISTANT COMPOSITION OF MATTER

REFERENCE TO RELATED PROVISIONAL APPLICATION

The Applicant hereby claims the benefit of the earlier filing date of Dec. 10, 2001, of Provisional Application Ser. No. 60/339,572, under 35 U.S.C. § 119(e), the entire contents of which provisional application is hereby incorporated herein by reference.

TECHNICAL FIELD OF THE INVENTION

This invention relates to a high strength, tarnish resistant composition of matter. In particular, this invention relates to a high strength, tarnish resistant silver composition for use in jewelry.

BACKGROUND OF THE INVENTION

The prior art is replete with examples of man's efforts to combine various materials in order to accomplish specific objectives. The art of metallurgy is no exception. By way of example, but not by limitation, a wide number of compositions of matter have been experimented with in the field of jewelry. Various parameters play a part in the selection of appropriate metals for use in jewelry. For example, cost, melt temperature, recyclability, hardness, ductility, stone setting, polishing, belt soldering, torch soldering, and Tig welding are some of the many parameters that come into play in the selection of various compositions of matter for use in jewelry and elsewhere.

Continuing with the jewelry example, again for the purposes of disclosure and not by way of limitation, a variety of prior art compositions concerning the use of silver in jewelry exist. United Precious Metal Refining Inc. of Alden, N.Y. advertises a type "57" composition that it says is a deoxidized sterling silver designed to achieve maximum hardness and also to eliminate fire scale and porosity. It is said to have a hardness approximately equal to standard sterling silver. The exact composition of type "57" is unknown to the Applicant and said to be "international patent pending." Applicant has tested this material and found it to be only somewhat tarnish resistant and not to have a hardness required for Applicant's use throughout the jewelry industry.

Additional prior art, of which the Applicant is aware, includes "Sterilite CFN" by the Astrolite Inc. company of Morton Grove, Ill. This material is said to be a 92.5 percent silver alloy that eliminates brittleness and is tarnish resistant. Applicant's testing confirmed that it was somewhat tarnish resistant but that, again, it did not have the hardness required for wide application in the jewelry industry.

Applicant has found no prior art composition that yielded a metal, particularly a silver, that was hard enough to withstand day-to-day wear and tear inflicted by users and which was non-tarnishing. One solution experimented with by the Applicant was simply to make the jewelry thicker so that the metal could pass a "squeeze" test. That is, all of the prior art compositions of silver tested by Applicant failed at least one of the tests applied by Applicant, including the test of durability. Some of the metals produced were so soft, in fact, that the rings could be squashed by hand.

As used herein, the term "hardness" means the property of a composition of material that enables it to resist plastic deformation, usually by penetration. However, the term hardness may also refer to resistance to bending, scratching, abrasion or cutting. The ususal method to achieve a hardness value is to measure the depth or area of an indentation left by an indenter of a specific force applied for a specific time. As is known by those of ordinary skill in the art, there are three principal standard test methods for expressing the relationship between hardness and the size of the impression, these being Brinell, Vickers (DPH), and Rockwell (Rs). For practical and calibration reasons, each of these methods is divided into a range of scales, defined by a combination of applied load and indenter geometry. Hardness conversion between different methods and scales is not an exact thing. Different loads, different shape indenters, homogeneity of specimens all complicate the problem. As a result, all conversions are known to be considered as giving approximate equivalents. Hardness may be measured at any point and after any known treatment such as rolling and annealing, for example only.

Thus, there is a need in the art for providing a high strength, tarnish resistant composition of matter that overcomes the drawbacks and deficiencies found in the prior art.

SUMMARY OF THE INVENTION

Accordingly, the high strength, tarnish resistant composition of the present invention includes, in a preferred embodiment, approximately 90 percent silver (Ag), 3 to 5 percent platinum (Pt) and 7 to 5 percent copper (Cu). In a further preferred embodiment, a high strength tarnish resistant composition includes 90 percent Ag, 3 percent Pt and 7 percent Cu. In another preferred embodiment, a high strength tarnish resistant composition includes 90 percent Ag, 5 percent Pt and 5 percent Cu.

DETAILED DESCRIPTION OF THE INVENTION

Applicant's composition is surprisingly and significantly harder, as determined by testing, than the prior art composition of 95 percent Ag and 5 percent Pt. That composition had a hardness rolled of about 112 DPH (Rs 63) and a hardness annealed of 57 DPH (Rs 5). By way of contrast, Applicant's composition of 90 percent Ag, 5 percent Pt and 5 percent Cu had a hardness rolled of 164 DPH (Rs 85) and a hardness annealed of 95 DPH (Rs 52). The above hardness values were taken with DPH as indicated and converted to Rs for illustration purposes. As discussed above, the converted Rockwell (Rs) values are only approximate.

Additional testing by Applicant has determined that the Applicant's composition as set forth above is softer than yellow gold but much harder than simple silver, which has a hardness of (15 Rb). Additionally, Applicant has determined that the above identified composition is extraordinarily tarnish resistant and casts well and finishes well. Further, Applicant's tests reveal that the subject composition of matter can be cast in gypsum investment and is a warn white color.

The description of the present embodiments of the invention have been presented for purposes of illustration but are not intended to be exhaustive or to limit the invention to the form disclosed. Many modifications and variations will be apparent to those of ordinary skill in the art. As such, while the present invention has been disclosed in connection with the preferred embodiment thereof, it should be understood that there may be other embodiments which fall within the spirit of the invention as set forth in the following claims.

What is claimed is:

1. A high strength tarnish resistant composition of matter comprising:

(a) about 90 percent silver of the composition weight;

(b) about 3 to 5 percent platinum of the composition weight; and (c) about 7 to 5 percent copper of the composition weight.

2. The composition of matter of claim 1 wherein element (b) is about 3 percent and element (c) is about 7 percent.

3. The composition of matter of claim 1 wherein element (b) is about 4 percent and element (c) is about 6 percent.

4. The composition of matter of claim 1 wherein element (b) is about 5 percent and element (c) is about 5 percent.

5. The composition of matter of claim 1 wherein the rolled hardness is about 164 DPH (Rs 85).

6. The composition of matter of claim 1 wherein the annealed hardness is about 95 DPH (Rs 52).

7. A high strength tarnish resistant composition of matter comprising:

(a) silver in the amount of about 90 percent of the composition weight;

(b) platinum in the amount of about 3 percent of the composition weight;

(c) copper in the amount of about 7 percent of the composition weight; and (d) wherein the rolled hardness is about 164 DPH (Rs 85).

8. The composition of matter of claim 7 wherein the annealed hardness is about 95 DPH (Rs 52).

9. A high strength tarnish resistant composition of matter comprising:

(a) silver in the amount of about 90 percent of the composition weight;

(b) platinum in the amount of about 4 percent of the composition weight;

(c) copper in the amount of about 6 percent of the composition weight; and (d) wherein the rolled hardness is about 164 DPH (Rs 85).

10. The composition of matter of claim 9 wherein the annealed hardness is about 95 DPH (Rs 52).

11. A high strength tarnish resistant composition of matter comprising:

(a) silver in the amount of about 90 percent of the composition weight;

(b) platinum in the amount of about 5 percent of the composition weight;

(c) copper in the amount of about 5 percent of the composition weight; and (d) wherein the rolled hardness is about 164 DPH (Rs 85).

12. The composition of matter of claim 11 wherein the annealed hardness is about 95 DPH (Rs 52).

* * * * *